US007766169B2

(12) United States Patent
St-Onge

(10) Patent No.: US 7,766,169 B2
(45) Date of Patent: Aug. 3, 2010

(54) STACKABLE EGG-BOX, STACK OF EGG-BOXES AND METHOD FOR DESTACKING SAID EGG-BOX

(75) Inventor: Yves St-Onge, Blainville (CA)

(73) Assignee: Interplast Packaging Inc., Terrebonne (CA)

( * ) Notice: Subject to any disclaimer, the term of this patent is extended or adjusted under 35 U.S.C. 154(b) by 582 days.

(21) Appl. No.: 10/934,400

(22) Filed: Sep. 7, 2004

(65) Prior Publication Data

US 2005/0189256 A1 Sep. 1, 2005

Related U.S. Application Data

(60) Provisional application No. 60/500,359, filed on Sep. 5, 2003.

(51) Int. Cl.
*B65D 85/32* (2006.01)

(52) U.S. Cl. ..... 206/521.1; 206/521.8; 206/519

(58) Field of Classification Search ..... 206/521.1, 206/521.7, 505, 515, 519, 521.8, 520
See application file for complete search history.

(56) References Cited

U.S. PATENT DOCUMENTS 3,144,972 A * 8/1964 Hartmann et al. ..... 206/521.8
3,442,420 A * 5/1969 Edwards ..... 206/520
3,563,450 A * 2/1971 Dahlberg ..... 206/521.1
3,567,107 A * 3/1971 Artz ..... 206/521.1
4,057,188 A * 11/1977 Steinhardt ..... 206/521.8
4,205,777 A * 6/1980 Brown et al. ..... 206/521.1
4,280,648 A * 7/1981 Boursier ..... 206/521.1
4,298,156 A * 11/1981 Reifers et al. ..... 206/521.1
4,361,263 A * 11/1982 Thomas ..... 206/521.1
4,863,094 A * 9/1989 Morrow et al. ..... 206/562
5,695,062 A * 12/1997 Lemaire ..... 206/521.8
5,927,501 A * 7/1999 Herbruck ..... 206/521.8
6,012,583 A * 1/2000 Ramirez ..... 206/521.1
2007/0151892 A1* 7/2007 St-Onge ..... 206/521.1

FOREIGN PATENT DOCUMENTS

CA 2028229 4/1992

* cited by examiner

*Primary Examiner*—J. Gregory Pickett
(74) *Attorney, Agent, or Firm*—Ogilvy Renault LLP

(57) ABSTRACT

A stackable tray obtained by vacuum molding of a sheet of plastic material, said tray comprising, in open position: a) a top and a bottom; b) at least one receiving cavity opened upwardly; c) spacing means to keep, in a stack of trays, the top portion and the bottom portion of neighboring trays at distance from each other to thereby prevent interlocking. A stack of said trays and a method using said trays.

14 Claims, 7 Drawing Sheets

STACKABLE EGG-BOX, STACK OF EGG-BOXES AND METHOD FOR DESTACKING SAID EGG-BOX

CROSS-REFERENCE TO RELATED APPLICATION

This application is a continuation-in-part of provisional application No. 60/500,359 filed on Sep. 5, 2003.

FIELD OF THE INVENTION

The invention relates to an improvement in trays obtained by thermoforming (e.g. vacuum moulding) of a sheet of plastic material and intended to be stacked (i.e. nested) one into the other before use. More particularly, each of said trays defines an egg-box into an opened position. The invention also relates to a stack of said trays and to a method for destacking (i.e. denesting) said trays.

BACKGROUND OF THE INVENTION

It is known in the art to obtain trays according to thermoforming techniques, especially vacuum moulding, and to stack them one into the other. It is also known to stack trays defining an egg-box into an opened position (see Applicant's Canadian Patent No. 2,028,229). However, when trays are stacked one into the other, friction and/or air lock may be created between neighboring trays. Such interlocking of trays involves that when a tray is picked up (or denested) from the stack, one or several neighboring trays may be simultaneously picked up. This drawback becomes very important when said stack of trays is intended to fed an automated packaging and/or labelling apparatus, especially an apparatus intended to fill egg-box trays with eggs. Indeed, when the apparatus become jammed, it has to be stopped and an operator must manually remove the jammed trays from the apparatus. There is a substantial lost of productivity and of course substantial risks of damaging the apparatus.

Therefore, there is a strong need for trays that can be stacked one into the other without creation of air lock or friction between neighboring trays, to allow an easy removal of each tray from the stack of trays.

There is also a strong need for a method allowing an easy removal of each tray from a stack of trays.

There is further a strong need for a device allowing to easily pick-up each tray from a stack of trays.

SUMMARY OF THE INVENTION

The Applicant has now discovered an innovative manner to prevent interlocking of neighboring trays in a stack of trays to thereby overcome the drawback existing with prior art trays.

The Applicant has further discovered an innovative method and device for an easy denesting of each tray of a stack of trays.

More particularly, the invention relates to a stackable tray obtained by thermoforming, especially vacuum molding, of a sheet of plastic material. Said tray comprises, in open position:

a) a top and a bottom;

b) at least one receiving cavity opened upwardly;

c) spacing means to keep, in a stack of trays, the top portion and the bottom portion of neighboring trays at distance from each other to thereby prevent interlocking therebetween. Advantageously, the air between trays is in fluid communication with the air surrounding a stack of trays to avoid pneumatic interlocking of trays.

Advantages of said trays are the following:

resistant, good protection of the integrity of egg-shells during packaging, storing and transport;

light in weight and inexpensive to manufacture;

may define a plate or bowl for receiving meals to be eaten by a traveler in a public transport (e.g. jet planes, buses, trains, etc.);

discourages the opening of the box by a customer in a grocery store;

when in close position, has a tight interlocking system preventing accidental opening of said box;

may have two closed boxes joined together by a portion of plastic sheet provided with a tearing line allowing to remove one box from the other, without affecting the integrity of said boxes.

Advantageously, according to a preferred embodiment, the invention also relates to a tray defining an egg-box obtained from a rectangular sheet of plastic and provided with a plurality of egg receiving cavities. Of course, other kind of boxes may be considered within the field of the invention. For example, said boxes may be a lunch box, a box for various articles (food items or not), etc.

Advantageously, the sheet of plastic material may consist of any appropriate thermoplastic material, especially polyethylene terephthalate sheet. Of course any equivalent thermoplastic sheet that can be thermoformed, especially by vacuum molding, may be used. The thickness of said sheet may vary between wide limits so far it is still possible to embody said tray by thermoforming techniques such as vacuum molding. Preferably, said thickness may be of 14 mil. Preferably, a clear and transparent thermoplastic sheet may be used.

Said trays may be obtained by any usual thermoforming techniques such as vacuum molding (i.e. by forming a sheet of thermoplastic material under the action of heat (e.g. by thermal convection) and a mechanical stress, this one being preferably obtained by air vacuum created at the base of the mould thanks to air vacuum nozzles.) Such techniques are well known to skilled workman and do not necessitate any substantial description in the present disclosure.

A man skilled in the art was not encouraged to embody a molded article by thermoforming, especially vacuum moulding, while said article has negative angles because the risk of having this article locked on the mould. However, surprisingly, the article can be easily removed from the mould to thereby allow the manufacture of trays provided with stoppers allowing to space apart neighboring trays in a stack of trays (in open position).

Advantageously, according to another preferred embodiment, the egg-box may comprise a first portion provided with the egg receiving cavities, a second portion defining an inner cover, and a third portion defining an outer cover; a fourth portion defining a hinge between the first portion and the second portion, and a fifth portion defining a hinge between the first portion and the third portion.

Advantageously, the tray may comprise characteristics analogous to the tray disclosed in Applicant's Canadian Patent no. 2,028,229. Preferably, in this patent the egg-box in an opened position defines a tray comprising:

(a) a first portion defining a first open container having at least one compartment intended to receive egg shells, and having a peripheric bearing surface, (b) a second portion defining a second open container having a number of compartments identical to the number of compartments of the first container and of construction sensibly similar to the one of the first open container, (c) a third portion defining a third open container having at least one compartment and of size slightly greater than the one of the first and second container, and having a peripheric bearing surface;

(d) a fourth portion defining first binding means allowing to bind said first and second containers, (e) a fifth portion defining second binding means allowing to bind said first and third containers, said second binding means being on a side of the first container that is opposite the one provided with the first binding means;

(f) first interlocking means to removably retain together said first and third containers into a closed position of the egg-box, once the egg-box folded into a closed position;

(g) second interlock means to removably retain together said first and third containers into a closed position of the egg-box and cooperating with the second container, once the egg-box folded into a closed position Advantageously, according to another preferred embodiment, each egg receiving cavity of the first portion may be further provided with a set of at least three (more preferably six) inwardly projecting ribs for supporting an egg. Preferably, said ribs may have a lower portion substantially straight in the bottom of the cavity and an upper portion curved to substantially fit with a corresponding contour of an egg. This particular structure is useful to prevent damage to an egg contained in said cavity.

Advantageously, according to another preferred embodiment, the second portion may be further provided with egg receiving cavities for the upper portion of eggs. Preferably, each of said receiving cavity of the second portion may be further provided with a set of at least three (more preferably six) inwardly projection ribs allowing to minimize movement of an egg housed in said cavities of the first and second portions. Advantageously, said ribs may have a portion substantially straight near the bottom of the cavity and a portion substantially curved to substantially fit with a corresponding contour of an egg. This particular structure, when used in combination with the one described in the preceding paragraph is much more efficient to prevent damage to an egg contained in said cavity.

Said ribs may be preferably equidistant. However, they could be distributed in different ways. The size of cavities is such to receive an egg shell of predetermined size (e.g. small, medium, large, extra-large, etc.). The egg shell is introduced in the cavity and is supported by said ribs, rather than by the side wall or by the bottom, The egg shell is advantageously at distance from the bottom of said cavity.

The fact that egg shell is retained by ribs is particularly advantageous in order to preserve the integrity of the egg shell. Indeed, any impact of the container with an outside object will prevent a direct impact on the egg shell, this later being at distance from the bottom of the container and from the side wall by ribs. Said ribs are not directly in contact with the outside of the container.

Advantageously, according to another preferred embodiment, spacing means may comprise at least one first stopper provided between cavities and/or cavities and periphery of each first and second portions, and at least one second stopper which may be provided between cavities and/or cavities and periphery of each first and second portions. Said stopper having at least one negative angle allows in a stack of said trays, to have its upper portion supporting the lower portion of corresponding stopper of a neighboring tray.

Advantageously, according to another embodiment of the invention, the first portion may comprises:

at least one group of first stoppers, preferably two first stoppers and more preferably four first stoppers; and at least one group of second stoppers, preferably two second stoppers and more preferably six second stoppers;

at least one of said stoppers having at least one negative angle. Preferably, some stoppers of a group of stoppers may have negative angles and some stoppers of the same group of stoppers may have positive angles. More preferably, some of the first stoppers have negative angles and some of the second stoppers have negative angles. Preferably, said first stoppers are positioned adjacent the periphery of the first portion. Preferably, said second stoppers are positioned between cavities of the first portion.

Advantageously, according to another embodiment of the invention, the second portion may comprise:

at least one group of first stoppers, preferably tow first stoppers and more preferably four first stoppers;

at least one group of second stoppers, preferably two second stoppers and more preferably six second stoppers; and optionally at least one group of third stoppers, preferably two third stoppers;

at least one of said stoppers having at least one negative angle. Preferably, some stoppers of a group of stoppers may have negative angles and some stoppers of the same group of stoppers may have positive angles. More preferably, some of the first stoppers have negative angles and some of the second stoppers have negative angles. Preferably, said first stoppers are positioned adjacent the periphery of the second portion. Preferably, said second stoppers are positioned between cavities of the second portion Third stopper preferably have positive angles and are preferably positioned at the corner of the periphery of the second portion.

Advantageously, according to another preferred embodiment, the first stoppers may be half-moon shaped and/or star shaped; the second stoppers may be circular shaped, half moon shaped and/or star shaped; and the third stoppers may be quarter-moon shaped.

Advantageously, according to another preferred embodiment, the third portion may be further provided with at least one substantially flat surface for receiving thereon a printed label, a printed stamp or both. For example, said flat surface may support an advertising label, and information stamp (printed directly on the surface), or both. Optionally, said label may be affixed on said surface (preferably inside the third portion) by any appropriate means such as for example gluing.

Advantageously, according to another preferred embodiment, the first portion and/or the second portion and the third portion, preferably the first portion, may be provided with at least one venting opening (preferably four venting openings). These venting openings allow a good ventilation of the inside of the box to thus prevent the gathering of humidity therein and allow a better preservation of its content (e.g. eggs). They may further contribute to prevent air locking of neighboring trays (in a stack of trays) by making easier the fluid communication of air entrapped between trays with the surrounding atmosphere (outside the stack).

Advantageously, according to another preferred embodiment, the inner cover and outer covers may be further provided with an interlocking means, preferably comprising at least one two parts fasteners (more preferably, four two parts fasteners).

Advantageously, according to another preferred embodiment, said tray may be further provided with means for facilitating denesting by an automated packaging and/or labeling apparatus. Preferably, said means may comprises projecting members provided on the outside of cavities near ends of the tray. More particularly, projecting members are provided by set of two on the outside of each cavities near ends of the tray to thus define a receiving track for a denesting tool.

The invention also relates to a stack of trays as defined hereinbefore.

The invention further relates to a method for denesting trays from a stack of empty trays to feed an automated packaging and/or labeling apparatus. Said method preferably comprises a step in which trays are successively picked up from a stack of trays as defined hereinbefore. Advantageously, a tool (e.g. a fork like tool) which is part of a packaging and/or labeling apparatus, engages a track defined by the projecting members and denests a tray from the bottom of the stack to feed said apparatus.

The invention further relates to an improved device for denesting trays from a stack of empty trays, and preferably carrying out the aforesaid method. This device is more preferably characterized in that it comprises a fork like tool for engagement with a corresponding receiving tracks of a tray to be individually picked-up from the bottom of a stack of trays, to be laid on a conveying means (e.g. a conveyor) and then disengaged from said receiving tracks and repositioned for engagement of the receiving tracks of a subsequent tray of the stack of trays.

BRIEF DESCRIPTION OF THE DRAWINGS

The present invention will be better understood with reference to the following drawings in which particularly preferred embodiments are described, said drawings respectively representing.

Figure 1:
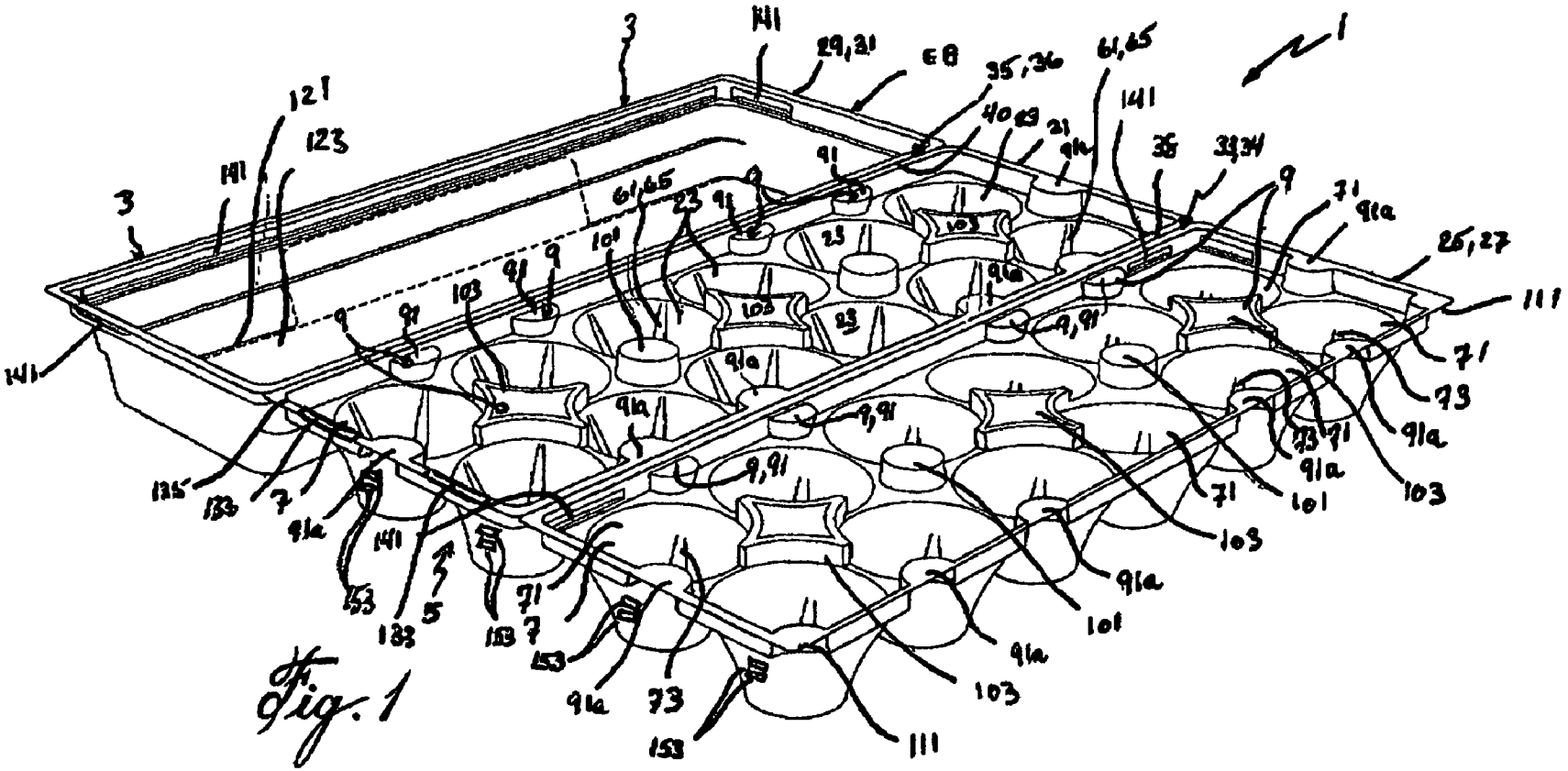
FIG. 1 is a perspective view of a preferred embodiment of a tray according to the invention.

BRIEF DESCRIPTION OF PARTICULARLY PREFERRED EMBODIMENTS AS REPRESENTED IN THE DRAWINGS

With reference to the enclosed drawings, there is represented especially in FIG. 1, a particularly preferred embodiment of the invention, that is a stackable tray 1 obtained by vacuum molding of a sheet of thermoplastic sheet, especially a transparent polyethylene terephthalate sheet having a 14 mil thickness. This tray 1 comprises, in open position:

a top portion 3 and a bottom portion 5;

receiving cavities 7 opened upwardly;

spacing means 9 to keep, in a stack S of trays, the top portion 3 and the bottom portion 5 of neighboring trays 1 at distance from each other to thereby prevent frictional or pneumatic interlocking therebetween.

Advantageously, the tray represented in FIG. 1 relates to a tray defining an egg-box EB provided with a plurality of egg receiving cavities 7. Of course, other kind of boxes may be considered within the field of the invention. For example, said boxes may be a lunch box, a box for various articles (food items or not), etc.

More particularly, as illustrated in the drawings, the egg-box EB may comprise a first portion 21 provided with the egg receiving cavities 23, a second portion 25 defining an inner cover 27, and a third portion 29 defining an outer cover 31; a fourth portion 33 defining a hinge 34 between the first portion 21 and the second portion 25, and a fifth portion 35 defining a hinge 36 between the first portion 21 and the third portion 29.

Figure 8:
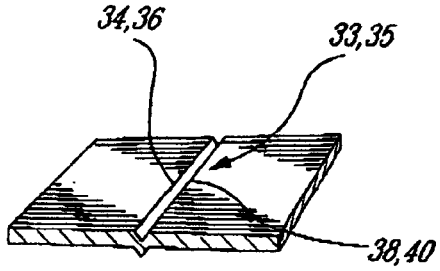
FIG. 8 is a partial view of the tray of FIG. 1 showing a preferred embodiment of a hinge according to the invention.

As illustrated in FIG. 8 the hinges 34, 36 may merely consist of a fold or a weakening line made in the thermoplastic material. Alternatively, the hinge could be any well known variation of plastic hinges. It is preferred to have hinges 34 and 36 defined as a mere fold in the plastic material. Such hinges are easy to manufacture and inexpensive. They can be made by any appropriate technique well known in the art. For example, the plastic sheet may be partially cut or weakened to define folding lines 38 and 40.

Figures 4, 5, 5A:
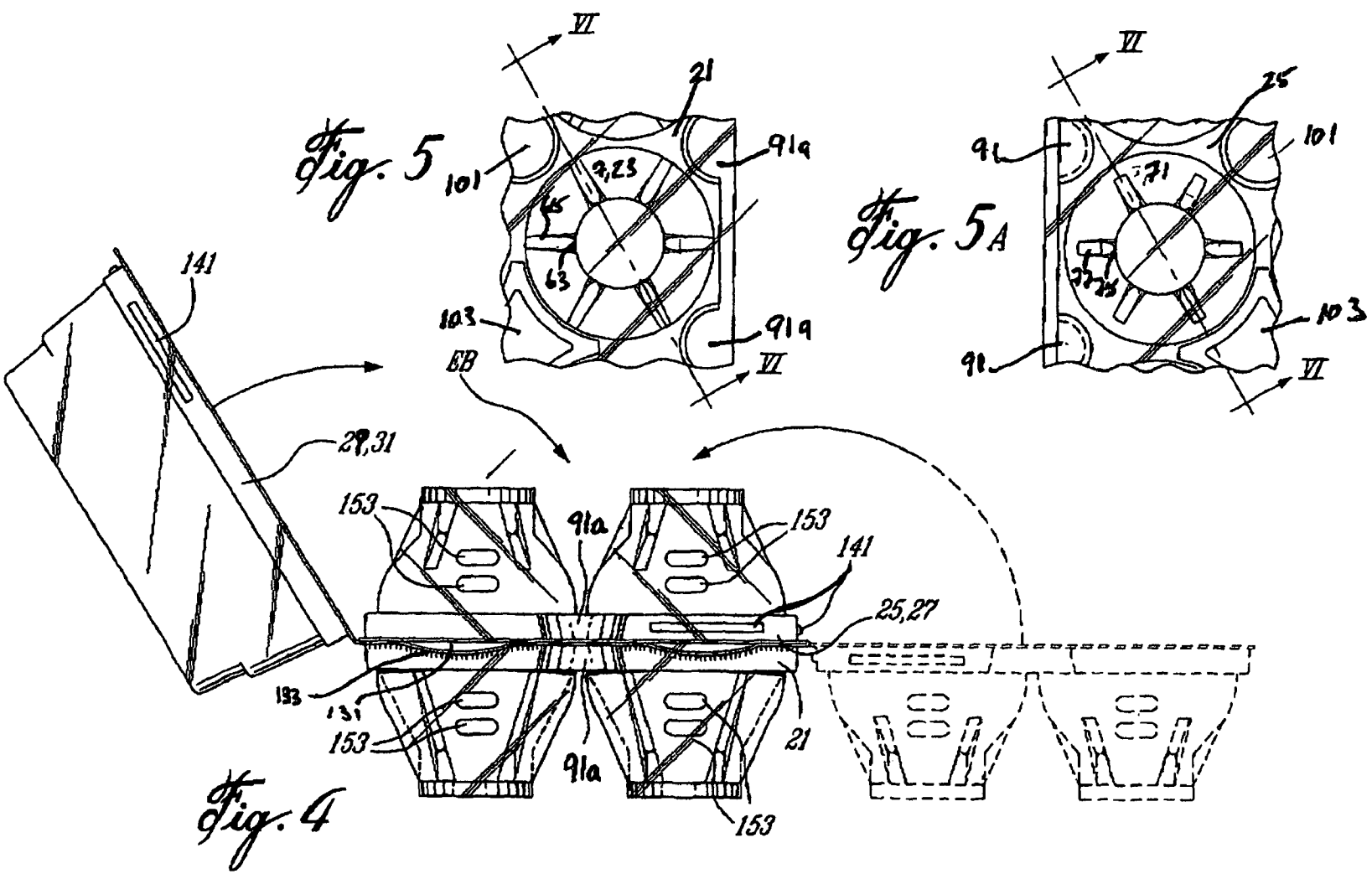
FIG. 4 is end elevational view of a tray of FIG. 1 with its second portion tilted over the first portion.
FIGS. 5 and 5*a* are a top plan view of a receiving cavity provided with ribs according to the invention.
Figure 6:
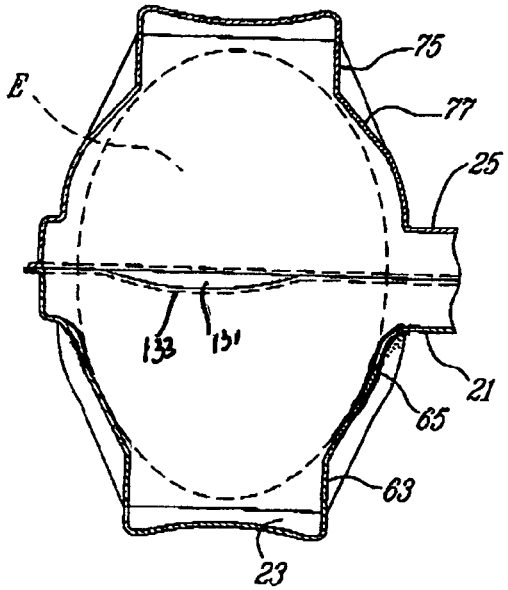
FIG. 6 is a cross sectional view according to line VI-VI in FIGS. 5 and 5*a* showing distinct portion of the ribs with respect to the contour of the egg (in dotted line)

As illustrated in FIGS. 5 and 6, each egg receiving cavity 23 may be further provided with a set of six inwardly projecting ribs 61 for supporting an egg E, preferably said ribs 61 having a lower portion 63 substantially straight in the bottom of the cavity 23 and an upper portion 65 curved to substantially fit with a corresponding contour of an egg E.

As illustrated in FIGS. 5*a* and 6, the second portion 25 may be further provided with egg receiving cavities 71 for the upper portion of eggs E. Preferably, each of said receiving cavities 71 may be further provided with a set of six inwardly projection ribs 73 allowing to minimize movement of an egg E to be housed in corresponding cavities 23 and 71. Advantageously, said ribs 73 may have a portion 75 substantially straight and a portion 77 substantially curved to substantially fit with a corresponding contour of an egg E.

As illustrated in FIGS. 1, 2, 3, 3*a*, 5 and 5*a*, spacing means 9 may comprise first stoppers 91 and second stoppers 103 having negative angles. In a stack S of open trays 1, upper portion 93 of stoppers 91 supports the lower portion 95 of corresponding first stoppers 91 of a neighboring tray 1, and stoppers 103 which have negative angles work similarly to stoppers 91, so as in a stack S of open trays 1, its upper portion supports the lower portion of corresponding stoppers 103 of a neighboring tray 1.

Optionally, as illustrated in FIGS. 1, 2, 3, 3*a*, 5 and 5*a*, first portion 21 and second portion 25 may further comprise first stoppers 91*a* having normal and/or positive angle(s), preferably positives angle(s).

Also, as illustrated in FIGS. 1, 2, 3, 3*a*, 5 and 5*a*, the first and second portions 21 and 25 may further comprise second stoppers 101 having normal and/or positive angle(s), preferably positive angle(s).

When the box is closed, these stoppers 91, 91*a*, 101 and 103 may be brought one against the other or closed to each other to consolidate the structural rigidity of the resulting box.

As illustrated in FIG. 1, the second portion 25 may be further provided with third stoppers 111 provided at the outer corners, said third stoppers 111 having positive angles. These stoppers 111 also contribute to consolidate the structural rigidity of the resulting box.

As illustrated in FIG. 1, stoppers 91 and 91*a* may have a substantially half-moon shaped; stoppers 101 and 103 may have a substantially circular shaped, half moon shaped and/or substantially star shaped; and stoppers 111 may be substantially quarter-moon shaped. Of course, said stoppers may have other geometric configurations. The above identified geometric choice are only illustrative and not limitative.

Figure 2:
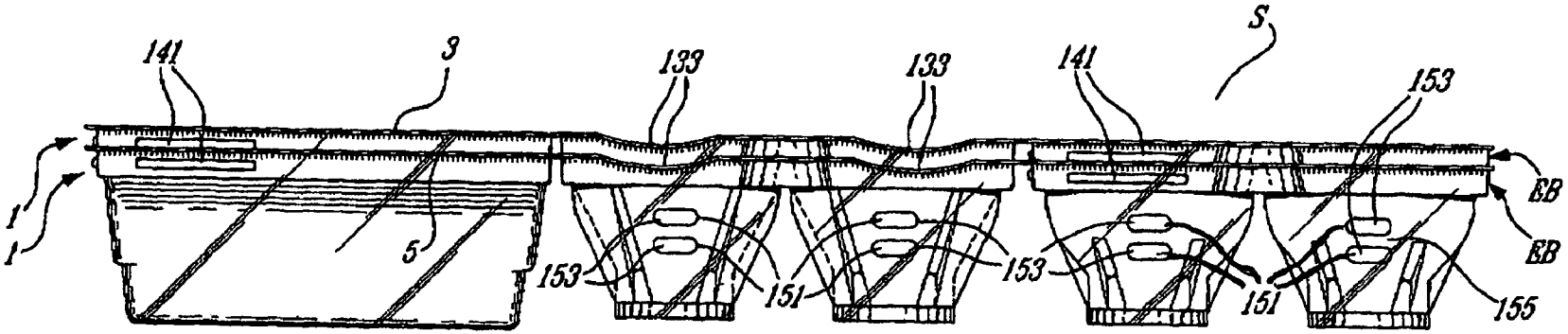
FIG. 2 is a side elevational view of two trays of FIG. 1 stack one into the other.
Figure 3:
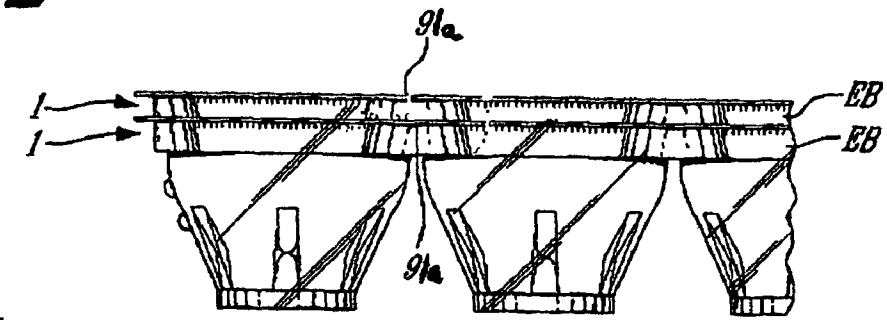
FIG. 3 is a partial view of FIG. 2 showing how works stoppers having negative angle.
Figure 3A:
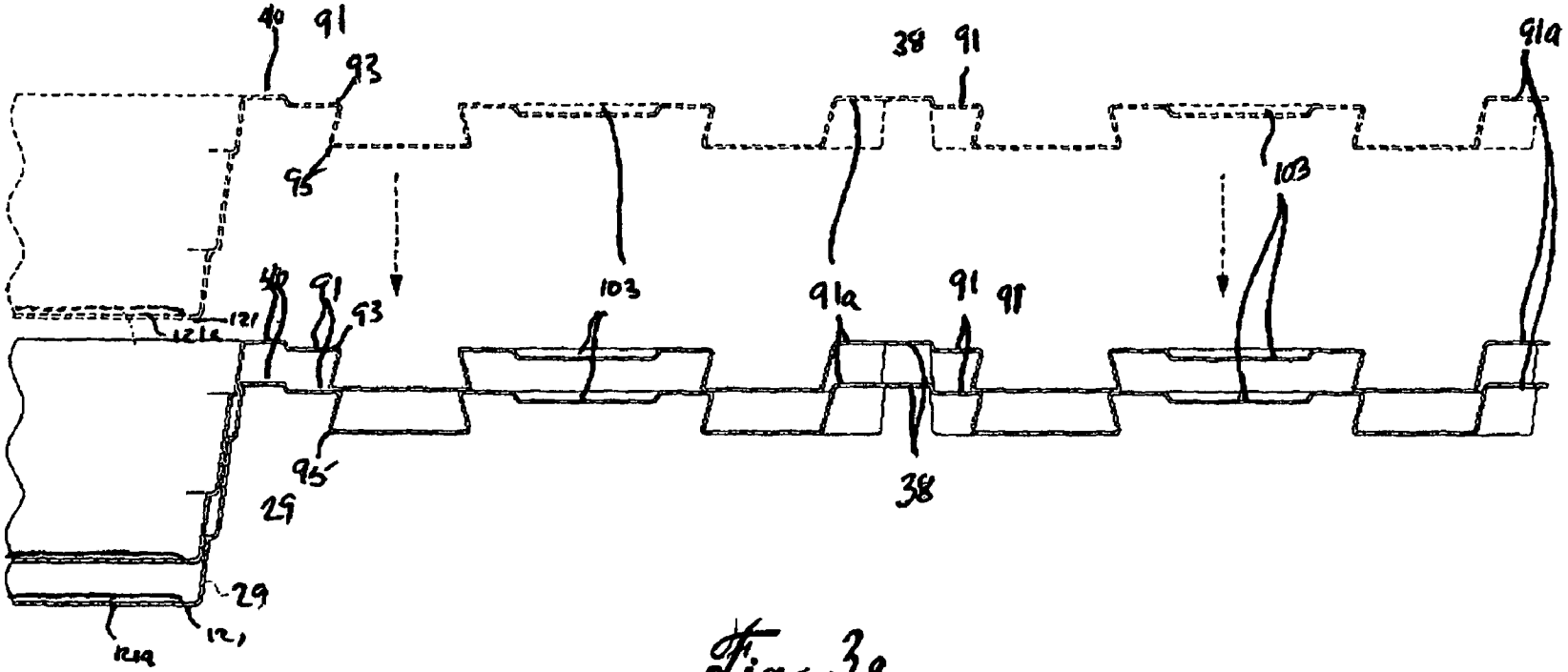
FIG. 3*a* is a partial cross-sectional view according to line IIIa-IIIa in FIG. 1 showing how stoppers work.
Figure 9:
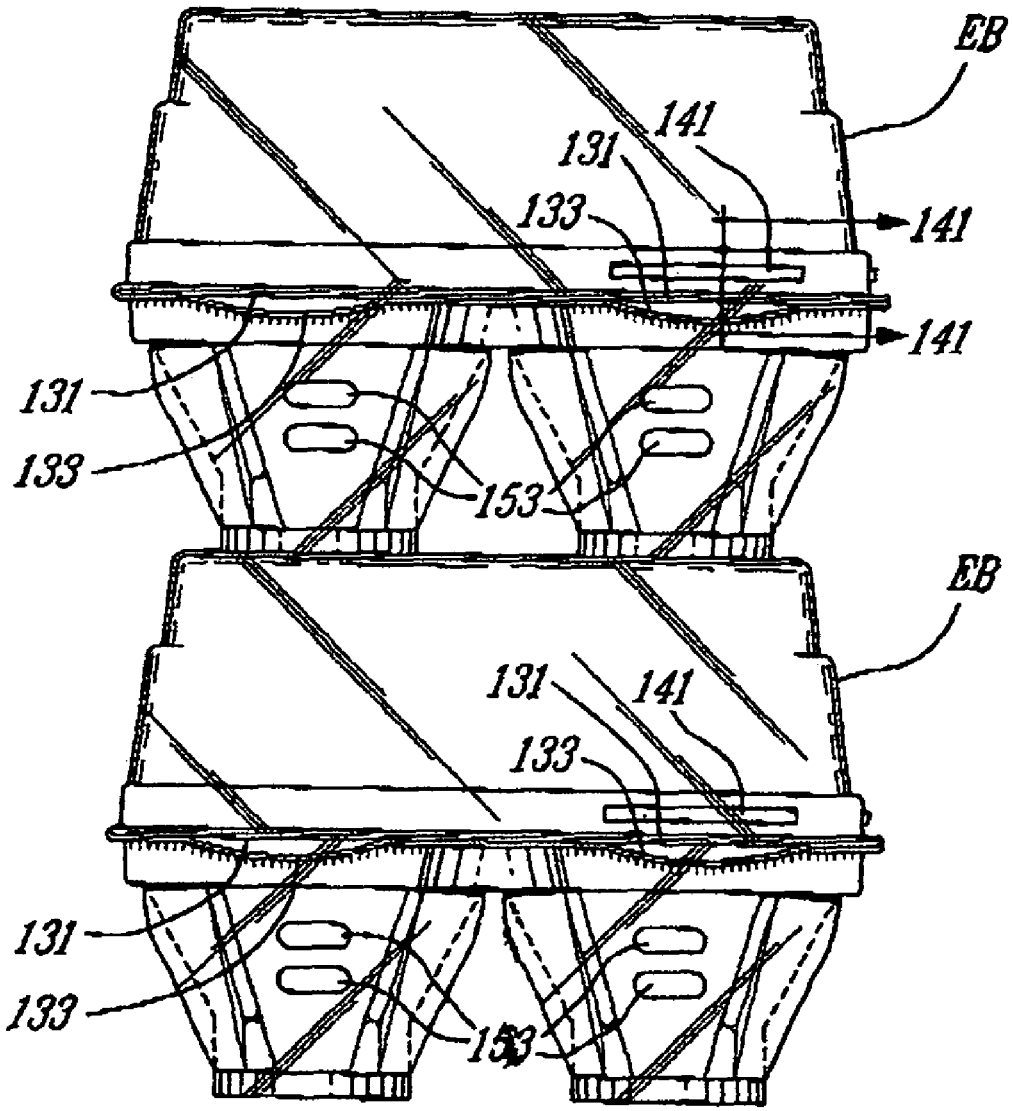
FIG. 9 is a end elevational view of two trays according to the invention, with their third and second portions successively tilted over the first portion, stacked one above the other.

As illustrated in FIGS. 1, 2 and 9, the third portion 29 may be further provided with at least one substantially flat surface 121 for receiving thereon a printed label, a printed stamp or both. For example, said flat surface 121 may support an advertising label 123. Alternatively, information may be printed directly on the surface (example: CUP code and/or peremption date), or both. Optionally, said label 123 may be glued on said surface. Optionally, the surface 121 may define a recess 121*a* (as illustrated in FIG. 3*a*).

As illustrated in FIGS. 1, 2, 3, 4 and 9, the first portion 21 may be further provided with venting means 131. Preferably, said means merely consist in a deformation 133 in a rim 135 of the box EB at the end of the first portion 21 of the tray 1. Alternatively, according to another preferred embodiment, the inner and outer cover may also be each provided with venting openings.

Figure 7:
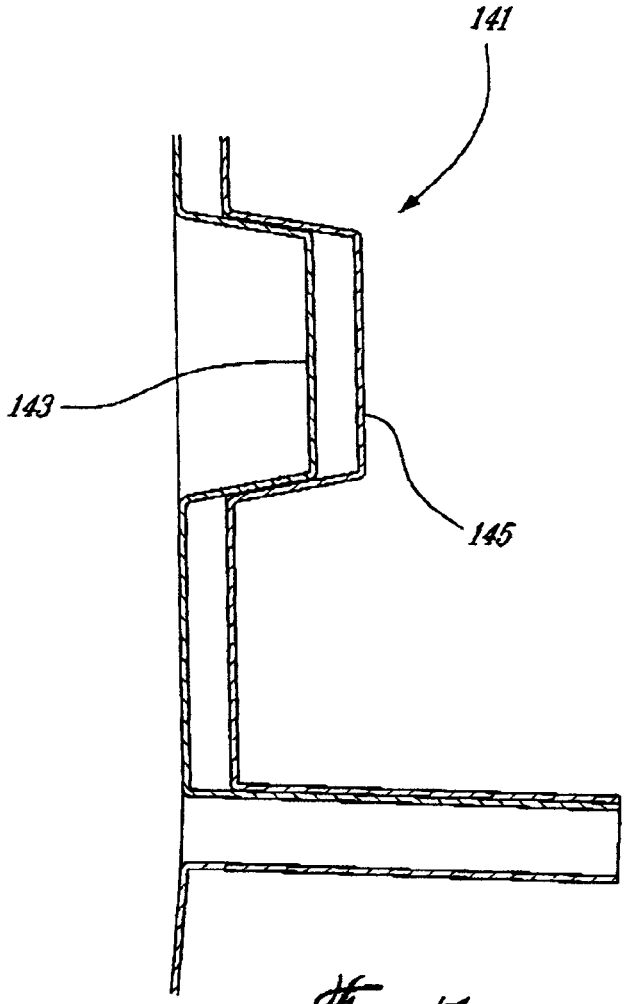
FIG. 7 is a cross sectional view according to line VII-VII in FIG. 9 showing a preferred embodiment of a two part fastener when said tray has its second and third portion tilted successively over the first portion.

As illustrated in FIGS. 1, 2, 4, 7 and 9, the inner cover and outer cover may be further provided with four sets of two parts fastener 141. Each fastener 141 has portions 143, 145 molded in the plastic that engages one into the other upon closure of the outer cover over the inner cover. Portions 143 and 145 have a rectangularly shaped profile. As seen in FIG. 7, the portions 143 and 145 define a tapered end. To open the box, reverse step are merely carried out. Boxes EB when in closed position, may be stacked as illustrated in FIG. 9. Preferably, the bottom of the box is received in the recess 121*a*.

Figures 10, 11:
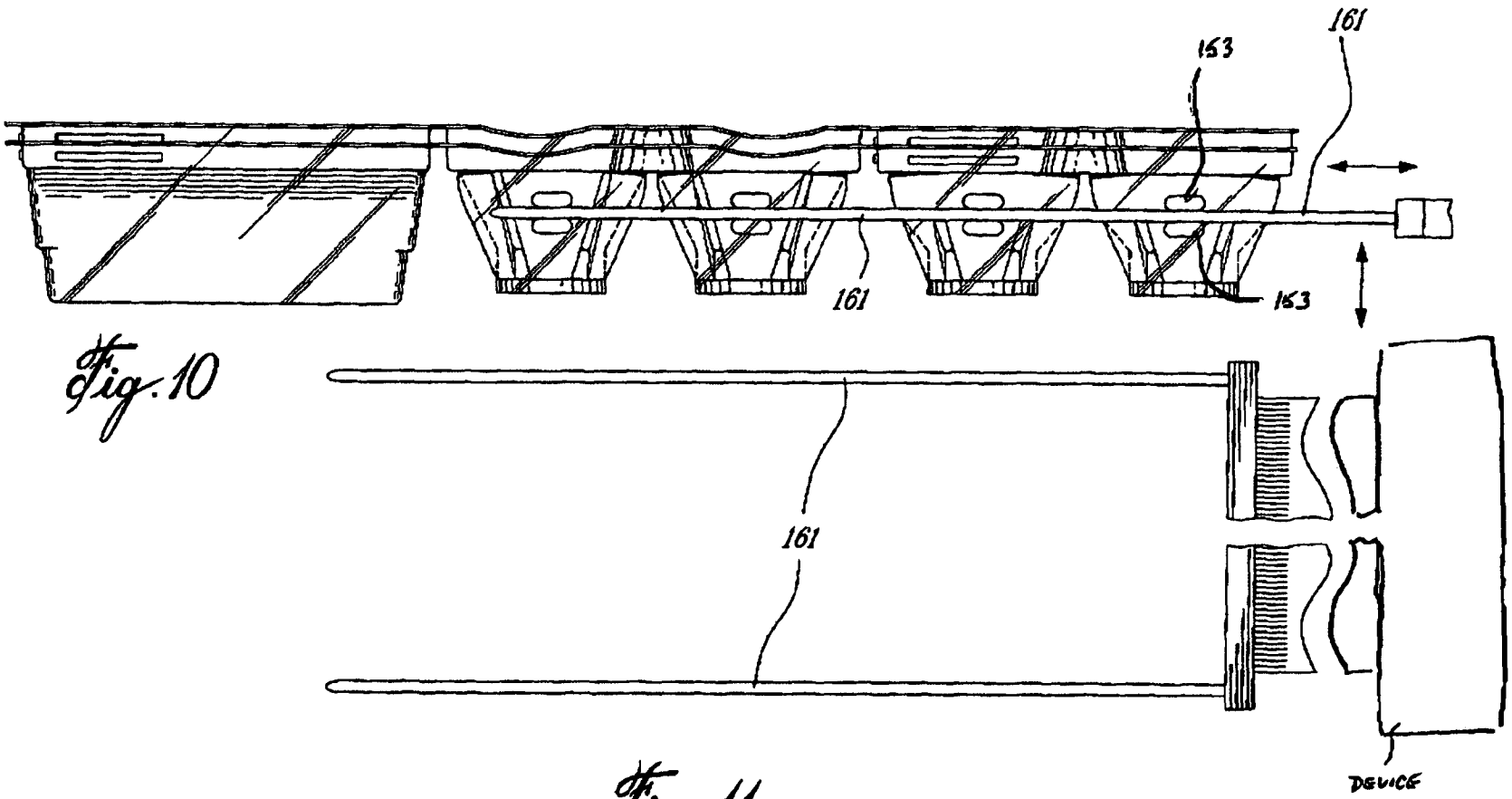
FIG. 10 is a schematic view of a tool of a packaging/labeling machine for picking up trays from a stack of trays according to the invention and put it on a conveying means (e.g. a conveyor)
FIG. 11 is a schematic view of a tool allowing to pick up the tray from the stack.

As illustrated in FIG. 2, said tray 1 may be further provided with means 151 for facilitating the denesting by an automated packaging and/or labeling apparatus. Preferably, said means may comprises projecting members 153 provided on the outside of cavities 23 near ends of the tray 1. More particularly, projecting members 153 are provided by set of two on the outside of each cavities 23 near ends of the tray 1 to thus define a receiving track 155 for a denesting tool 161 (see FIGS. 10 and 11).

The invention also relates to a stack S of trays 1 as defined hereinbefore.

The invention further relates to a method for denesting trays 1 from a stack S of empty trays 1 to feed an automated packaging and/or labeling apparatus, said method comprising a step in which trays are successively picked up from a stack S of trays 1 as defined hereinbefore. Advantageously, a tool 161 (e.g. a fork like tool) which is part of a packaging and/or labeling apparatus, engages the tracks 155 (on both sides of the tray 1) defined by the projecting members 153 and denests a tray 1 from the bottom of the stack S to feed said apparatus. Preferably, the tool 161 engages the tracks 155, moves the tray 1 at the bottom of the stack downwardly on an appropriate conveyer means C, and then withdraw from the tracks 155. As illustrated, there are advantageously 16 projecting members 153, eight on each side of the tray 1. The invention also relates to a device comprising a tool 161 for carrying out the aforesaid method.

The present invention is not limited to the preferred embodiments recited hereinbefore and also relate to any variation and equivalent that may appear to be obvious to a skilled workman.

What is claimed is:

1. A stackable tray obtained by vacuum molding of a sheet of plastic material, said tray comprising, in open position:

a) a top and a bottom;

b) a first portion with at least two rows of receiving cavities opened upwardly;

c) at least a second portion hinged to the first portion;

d) spacing means to keep, in a stack of trays, the top portion and the bottom portion of neighboring trays at distance from each other to thereby prevent interlocking, the spacing means comprising:

at least one group of first stoppers each having a first horizontal support portion and a first slanted portion in an obtuse angle relation with the first horizontal support portion from top to bottom, and being positioned between one of the rows and the periphery of the tray; and at least one group of second stoppers each having a second horizontal support portion and a second slanted portion in an acute angle relation with the second horizontal support portion, and being positioned:

(1) between said rows of cavities interiorly of the periphery of the tray; and/or (2) between one of said rows and the hinge between the first portion and the second portion;

whereby when the trays are stacked, the group of first stoppers of an upper tray are adjacent to but separated from the group of first stoppers of a lower tray, and the group of second stoppers of the upper tray are seated on the group of second stoppers of the lower tray, thereby preventing interlocking between trays about the periphery of the trays and interiorly of the periphery of the trays.

2. A stackable tray according to claim 1, wherein said tray defines an egg-box obtained from a rectangular sheet of plastic and wherein said receiving cavities are egg receiving cavities.

3. A stackable tray according to claim 2, wherein the egg-box comprises a first portion provided with the egg receiving cavities, a second portion defining an inner cover, and a third portion defining an outer cover; a fourth portion defining a hinge between the first portion and the second portion, and a fifth portion defining a hinge between the first portion and the third portion.

4. A stackable tray according to claim 3, wherein each egg receiving cavity is further provided with a set of at least three inwardly projecting ribs for supporting an egg, said ribs having a lower portion substantially straight in the bottom of the cavity and an upper portion curved to substantially fit with a corresponding contour of an egg.

5. A stackable tray according to claim 3, wherein each egg receiving cavity is further provided with a set of six inwardly projecting ribs for supporting an egg, said ribs having a lower portion substantially straight in the bottom of the cavity and an upper portion curved to substantially fit with a corresponding contour of an egg.

6. A stackable tray according to claim 3, wherein the second portion is further provided with egg receiving cavities for the upper portion of eggs receiving cavity is further provided with a set of six inwardly projecting ribs for supporting an egg, said ribs having a lower portion substantially straight in the bottom of the cavity and an upper portion curved to substantially fit with a corresponding contour of an egg.

7. A stackable tray according to claim 3, wherein the third portion is provided with at least one substantially flat surface for receiving thereon a printed label, a printed stamp or both.

8. A stackable tray according to claim 3, wherein the inner and outer cover are each provided with venting openings.

9. A stackable tray according to claim 3, wherein the inner cover and outer cover are provided with interlocking means.

10. A stackable tray according to claim 9, wherein the interlocking means comprise a pair of two parts fastener.

11. A stackable tray according to claim 3, wherein means are provided to facilitate movement of the tray on an automated packaging/labeling apparatus.

12. A stackable tray according to claim 11, wherein said means to facilitate movement of the tray through an automated packaging/labeling apparatus comprise pair of small protuberances provided on the outer face of cavities near end of trays.

13. A stackable tray according to claim 1, further comprising a third portion hinged to the second portion, with the first portion forming an inner cover, the second portion forming a base, and the third portion forming an outer cover, with rows of the receiving cavities being in the first portion and the second portion.

14. A stackable tray according to claim 13, comprising another group of the second stoppers between one of the rows of receiving cavities of the second portion and the hinge between the second portion and the third portion.

* * * * *

UNITED STATES PATENT AND TRADEMARK OFFICE

CERTIFICATE OF CORRECTION

PATENT NO. : 7,766,169 B2
APPLICATION NO. : 10/934400
DATED : August 3, 2010
INVENTOR(S) : Yves St-Onge It is certified that error appears in the above-identified patent and that said Letters Patent is hereby corrected as shown below:

IN THE CLAIMS:

At column 8, line 23:
"and the bottom portion of neighboring trays at distance" should read
-- and the bottom portion of neighboring trays at a distance --

At column 9, line 6:
"the upper portion of eggs receiving cavity is further provided" should read
-- the upper portion of eggs, each receiving cavity is further provided --

At column 10, line 6:
"mated packaging/labeling apparatus comprise pair of small" should read
-- mated packaging/labeling apparatus comprise a pair of small --

At column 10, line 7:
"protuberances provided on the outer face of cavities near end" should read
-- protuberances provided on the outer face of cavities near an end --

At column 10, line 8:
"of trays." should read
-- of the trays. --

Signed and Sealed this
Twenty-first Day of April, 2015

Michelle K. Lee

Michelle K. Lee
*Director of the United States Patent and Trademark Office*